US006393616B1

(12) United States Patent
Woodard

(10) Patent No.: US 6,393,616 B1
(45) Date of Patent: May 28, 2002

(54) FINGER PROTECTION DEVICE FOR A MUSICIAN

(76) Inventor: Randal M. Woodard, Box #102, Lake Denton, WI (US) 53940

( * ) Notice: Subject to any disclaimer, the term of this patent is extended or adjusted under 35 U.S.C. 154(b) by 0 days.

(21) Appl. No.: 09/910,258

(22) Filed: Jul. 20, 2001

(51) Int. Cl.[7] ..... A41D 19/00
(52) U.S. Cl. ..... 2/163
(58) Field of Search ..... 2/163, 159, 161.1, 2/161.3, 161.5, 161.6, 167, 20, 21, 910, 161.2

(56) References Cited

U.S. PATENT DOCUMENTS 527,704 A * 10/1894 Merrill ..... 2/163
4,507,807 A * 4/1985 Karkanen ..... 2/161.1
4,519,097 A 5/1985 Chappell et al.
4,774,727 A 10/1988 Jackson
5,033,120 A * 7/1991 Myers ..... 2/161.1
5,390,371 A 2/1995 Sigward
D391,683 S 3/1998 Heringer
5,924,137 A 7/1999 Gold
6,009,557 A 1/2000 Witta
6,029,276 A * 2/2000 White ..... 2/161.6

* cited by examiner

*Primary Examiner*—Gloria M. Hale
*Assistant Examiner*—Tejash Patel

(57) ABSTRACT

A finger protection device for a musician for preventing injury to the fingertips of a person playing a stringed instrument. The finger includes a glove having palm portion, a back hand portion, a thumb receiving member and a plurality of finger receiving members. The glove has an opening therein for receiving the hand of a user. Each of the finger members includes an end portion. The tips of the fingers of the user are extendable into the end portions such that the end portions cover the tips of the fingers. Each of the end portions comprises an elastomeric material.

5 Claims, 2 Drawing Sheets

FINGER PROTECTION DEVICE FOR A MUSICIAN

BACKGROUND OF THE INVENTION

1. Field of the Invention

The present invention relates to finger protection devices and more particularly pertains to a new finger protection device for a musician for preventing injury to the fingertips of a person playing a stringed instrument.

2. Description of the Prior Art

The use of finger protection devices is known in the prior art. More specifically, finger protection devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,390,371; U.S. Pat. No. 6,009,557; U.S. Pat. No. 5,924,137; U.S. Pat. No. 4,591,097; U.S. Pat. No. 4,774,727; and U.S. Des. Pat. No. 391,683.

While these devices fulfill their respective, particular objectives and requirements, the aforementioned patents do not disclose a new finger protection device for a musician. The inventive device includes a glove having palm portion, a back hand portion, a thumb receiving member and a plurality of finger receiving members. The glove has an opening therein for receiving the hand of a user. Each of the finger members includes an end portion. The tips of the fingers of the user are extendable into the end portions such that the end portions cover the tips of the fingers. Each of the end portions comprises an elastomeric material.

In these respects, the finger protection device for a musician according to the present invention substantially departs from the conventional concepts and designs of the prior art, and in so doing provides an apparatus primarily developed for the purpose of preventing injury to the fingertips of a person playing a stringed instrument.

SUMMARY OF THE INVENTION

In view of the foregoing disadvantages inherent in the known types of finger protection devices now present in the prior art, the present invention provides a new finger protection device for a musician construction wherein the same can be utilized for preventing injury to the fingertips of a person playing a stringed instrument.

The general purpose of the present invention, which will be described subsequently in greater detail, is to provide a new finger protection device for a musician apparatus and method which has many of the advantages of the finger protection devices mentioned heretofore and many novel features that result in a new finger protection device for a musician which is not anticipated, rendered obvious, suggested, or even implied by any of the prior art finger protection devices, either alone or in any combination thereof.

To attain this, the present invention generally comprises a glove having palm portion, a back hand portion, a thumb receiving member and a plurality of finger protection device for a musician receiving members. The glove has an opening therein for receiving the hand of a user. Each of the finger members includes an end portion. The tips of the fingers of the user are extendable into the end portions such that the end portions cover the tips of the fingers. Each of the end portions comprises an elastomeric material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new finger protection device for a musician apparatus and method which has many of the advantages of the finger protection devices mentioned heretofore and many novel features that result in a new finger protection device for a musician which is not anticipated, rendered obvious, suggested, or even implied by any of the prior art finger protection devices, either alone or in any combination thereof.

It is another object of the present invention to provide a new finger protection device for a musician which may be easily and efficiently manufactured and marketed.

It is a further object of the present invention to provide a new finger protection device for a musician which is of a durable and reliable construction.

An even further object of the present invention is to provide a new finger protection device for a musician which is susceptible of a low cost of manufacture with regard to both materials and labor, and which accordingly is then susceptible of low prices of sale to the consuming public, thereby making such finger protection device for a musician economically available to the buying public.

Still yet another object of the present invention is to provide a new finger protection device for a musician which provides in the apparatuses and methods of the prior art some of the advantages thereof, while simultaneously overcoming some of the disadvantages normally associated therewith.

Still another object of the present invention is to provide a new finger protection device for a musician for preventing injury to the fingertips of a person playing a stringed instrument.

Yet another object of the present invention is to provide a new finger protection device for a musician which includes a glove having palm portion, a back hand portion, a thumb receiving member and a plurality of finger protection device for a musician receiving members. The glove has an opening therein for receiving the hand of a user. Each of the finger members includes an end portion. The tips of the fingers of the user are extendable into the end portions such that the end portions cover the tips of the fingers. Each of the end portions comprises an elastomeric material.

Still yet another object of the-present invention is to provide a new finger protection device for a musician that contains cushioning material in the device for protecting the fingertip of the user.

These together with other objects of the invention, along with the various features of novelty which characterize the invention, are pointed out with particularity in the claims annexed to and a forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
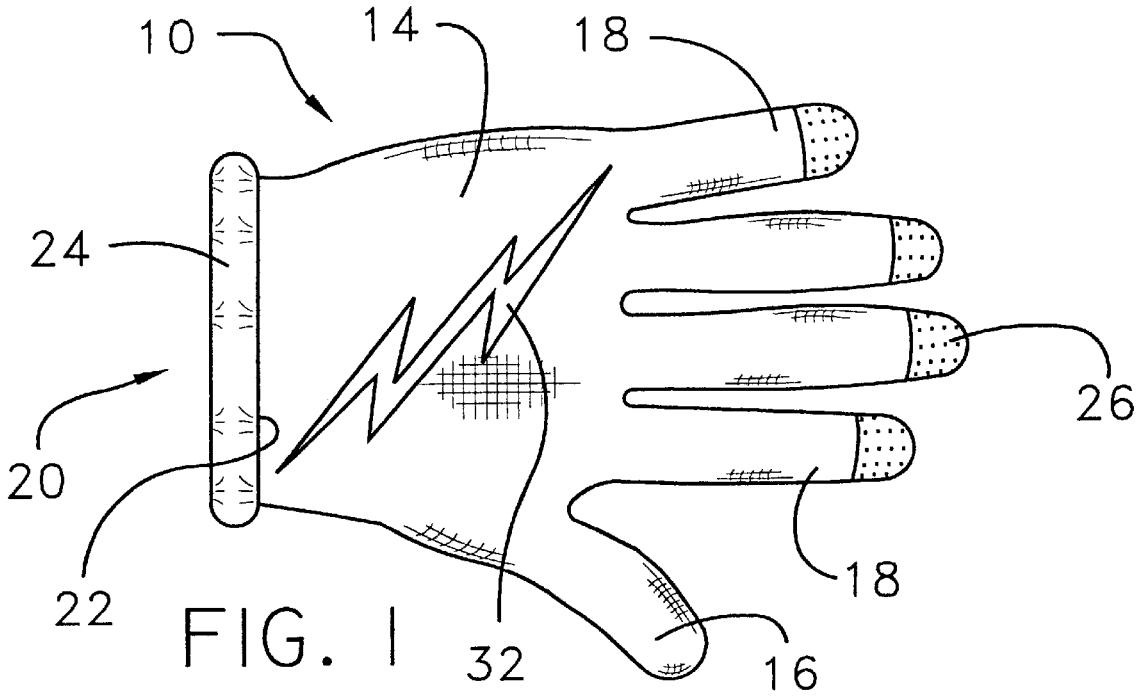
FIG. 1 is a schematic top view of a new finger protection device for a musician according to the present invention.
Figure 2:
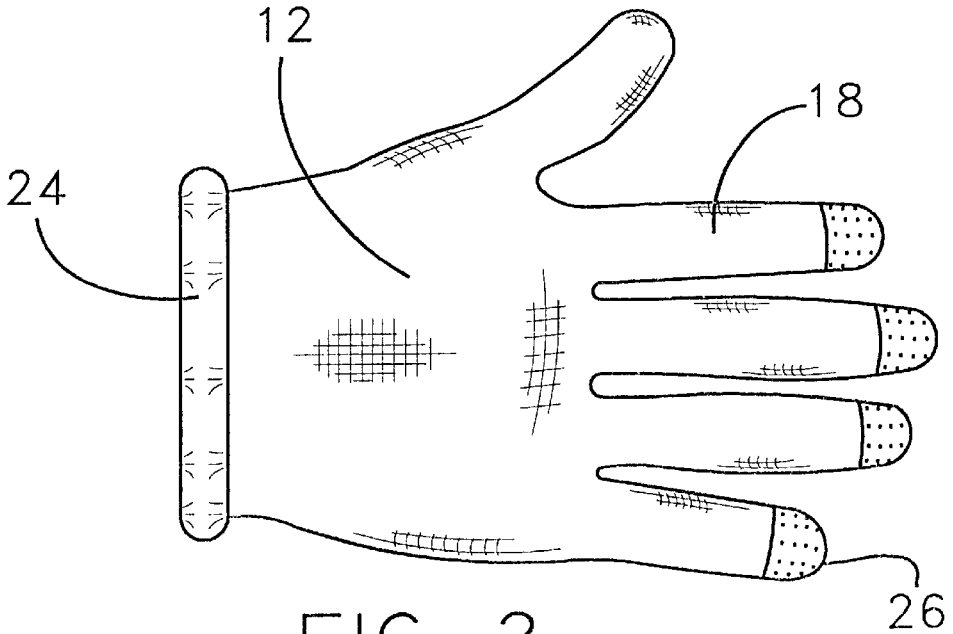
FIG. 2 is a schematic bottom view of the present invention.
Figure 3:
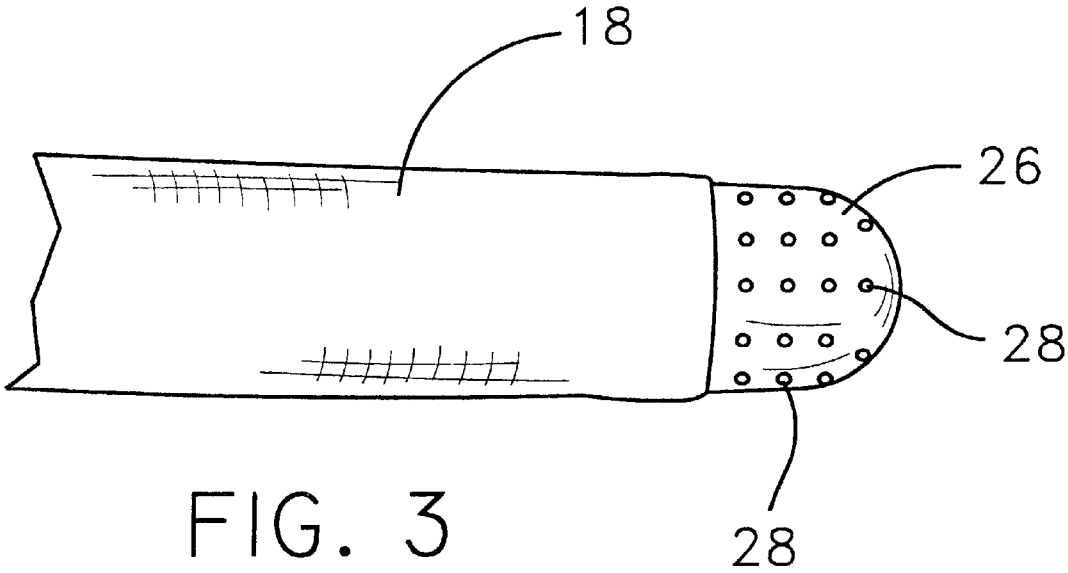
FIG. 3 is a schematic side view of the present invention.
Figure 4:
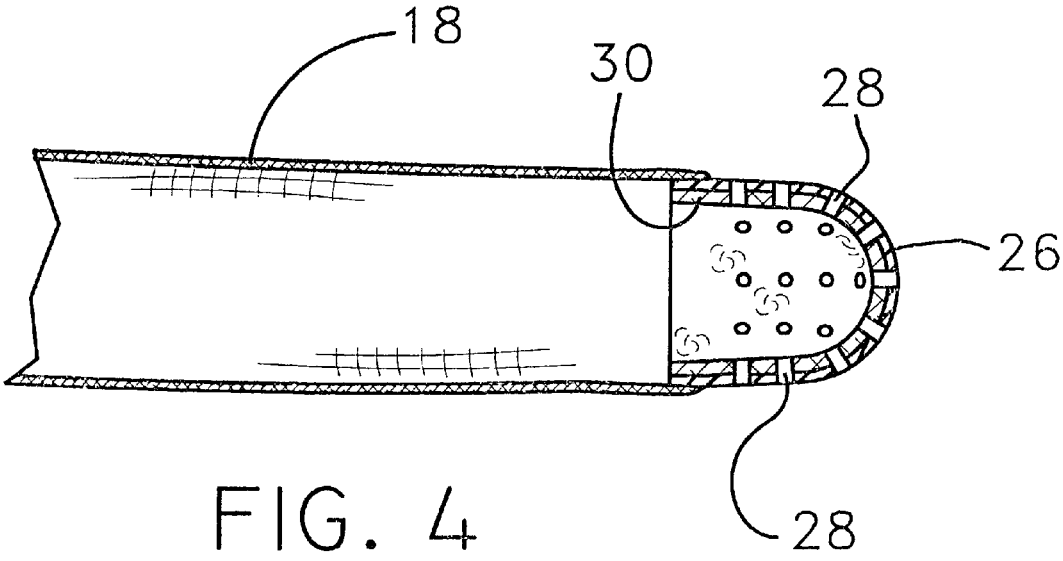
FIG. 4 is a schematic cross-sectional view of a finger member of the present invention.

With reference now to the drawings, and in particular to FIGS. 1 through 4 thereof, a new finger protection device for a musician embodying the principles and concepts of the present invention and generally designated by the reference numeral 10 will be described.

As best illustrated in FIGS. 1 through 4, the finger protection device for a musician 10 generally comprises a glove having palm portion 12, a back hand portion 14, a thumb receiving member 16 and a plurality of finger receiving members 18. The glove has an opening 20 therein for receiving the hand of a user. The opening 20 has a perimeter edge 22. A resiliently elastic member 24 is attached to and extends around the perimeter edge 22. Each of the finger members 18 includes an end portion 26. The tips of the fingers of the user are extendable into the end portions 26 such that the end portions 26 cover the tips of the fingers. Each of the end portions 26 comprises an elastomeric material. Each of the end portions 26 has a plurality of apertures 28 extending therethrough. Each of the palm portion 12, back hand portion 14, thumb receiving member 16 and finger receiving members 18 preferably comprise a nylon material. The end portions 26 are integrally coupled to the nylon material.

Each of a plurality of cushioning members 30 is attached to and generally covers an internal surface of one of the end portions 26. The apertures 28 extend through the cushioning members 30. Each of the cushioning members 30 preferably comprises a foamed material.

In use, the device 10 is worn over a hand of the user when playing a guitar. The end portions 26 protect the finger tips from the strings of an instrument. The apertures 28 allow air to enter through the end portions to keep the fingertips cool and allow escape of any perspiration. Because the device 10 is preferably constructed primarily of nylon, the user's hand is generally visible through the glove. This allows for creative designs 32 to be positioned on the device 10 which appear to be directly on the hand of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A finger protection device for protecting fingers of a person playing a stringed instrument, said device comprising:

a glove having a palm portion, a back hand portion, a thumb receiving member and a plurality of finger receiving members, said glove having an opening therein for receiving the hand of a user each of said finger members including an end portion, wherein the tips of the fingers of the user are extendable into said end portions such that said end portions cover the tips of the fingers, each of said end portions comprising an elastomeric material; and each of said end portions having a plurality of apertures extending therethrough that includes a plurality of cushioning members, each of said cushioning members being attached to and generally covering an internal surface of one of said end portions, said apertures extending through said cushioning members.

2. The finger protection device as in claim 1, wherein said opening of said glove has a perimeter edge, a resiliently elastic member being attached to and extending around said perimeter edge.

3. The finger protection device as in claim 1, wherein each of said palm portion, back hand portion, thumb receiving member and finger receiving members comprise a nylon material, said end portions being integrally coupled to said nylon material.

4. The finger protection device as in claim 1, further including a plurality of cushioning members, each of said cushioning members being attached to and generally covering an internal surface of one of said end portions.

5. A finger protection device for protecting fingers of a person playing a stringed instrument, said device comprising:

a glove having palm portions a back hand portion, a thumb receiving member and a plurality of finger receiving members, said glove having an opening therein for receiving the hand of a user, said opening having a perimeter edge, a resiliently elastic member being attached to and extending around said perimeter edge, each of said finger members including an end portion, wherein the tips of the fingers of the user are extendable into said end portions such that said end portions cover the tips of the fingers, each of said end portions comprising an elastomeric material, each of said end portions having a plurality of apertures extending therethrough, each of said palm portion, back hand portion, thumb receiving member and finger receiving members comprising a nylon material, said end portions being integrally coupled to said nylon material;

a plurality of cushioning members, each of said cushioning members being attached to and generally covering an internal surface of one of said end portions, said apertures extending through said cushioning members, each of said cushioning members comprising a foamed material.

* * * * *